US009527220B1

(12) United States Patent
Drouillard

(10) Patent No.: US 9,527,220 B1
(45) Date of Patent: Dec. 27, 2016

(54) HEAT-APPLYING SHAVING DEVICE

(71) Applicant: Gerald E. Drouillard, Royal Oak, MI (US)

(72) Inventor: Gerald E. Drouillard, Royal Oak, MI (US)

( * ) Notice: Subject to any disclaimer, the term of this patent is extended or adjusted under 35 U.S.C. 154(b) by 0 days.

(21) Appl. No.: 15/040,666

(22) Filed: Feb. 10, 2016

(51) Int. Cl.
*B26B 21/48* (2006.01)
*B26B 21/40* (2006.01)

(52) U.S. Cl.
CPC ..... *B26B 21/48* (2013.01); *B26B 21/4012* (2013.01)

(58) Field of Classification Search
CPC .. B26B 21/48; B26B 21/4012; B26B 21/4068; B26B 21/4075
USPC ..... 30/34.1, 47, 34.05
See application file for complete search history.

(56) References Cited

U.S. PATENT DOCUMENTS

| | | | | |
|---|---|---|---|---|
| 979,296 A | | 12/1910 | Heissenberger | |
| 1,701,036 A | * | 2/1929 | Greene | B26B 21/34 30/36 |
| 1,756,639 A | | 4/1930 | Greene | |
| 2,083,580 A | | 6/1937 | Schmitt | |
| 2,155,749 A | * | 4/1939 | Oldham | B26B 21/18 30/346.57 |
| 2,198,531 A | | 4/1940 | Fulenwider | |
| 2,421,540 A | * | 6/1947 | Clarke | B26B 21/00 30/346.5 |
| 2,439,909 A | * | 4/1948 | Ruskin | B26B 21/28 30/304 |
| 2,515,524 A | | 7/1950 | Manzel | |
| 2,677,883 A | | 5/1954 | Schallgruber | |
| 2,861,338 A | | 11/1958 | Boland | |
| 3,340,609 A | * | 9/1967 | Sacharow | B26B 21/14 30/47 |
| 3,492,723 A | * | 2/1970 | Mollica | B26B 21/06 30/47 |
| 3,895,437 A | | 7/1975 | DiBuono | |
| 4,074,429 A | | 2/1978 | Roberts | |
| 4,127,067 A | | 11/1978 | Dahlgren et al. | |
| 4,845,846 A | | 7/1989 | Sinka | |
| 5,133,130 A | | 7/1992 | Podolsky | |
| 5,267,399 A | | 12/1993 | Johnston | |
| 5,604,983 A | | 2/1997 | Simms et al. | |

(Continued)

FOREIGN PATENT DOCUMENTS

GB 2 179 286 A * 3/1987

OTHER PUBLICATIONS www.sharpologist.com "One Man's Unusual Straight Razor Journey" by Steve. Sep. 11, 2015.

(Continued)

*Primary Examiner* — Hwei C Payer
(74) *Attorney, Agent, or Firm* — Young Basile Hanlon & MacFarlane, P.C.

(57) ABSTRACT

A hand held heat-applying shaving device made up of body with a shape approximating that of a rectangular prism and having a first panel of stone such as granite and a second mating panel of metal such as titanium. In use the device is heated by immersion in hot water and the surface of the metal panel is then place against the face or other body part to be shaved. Shaving is achieved by means of a replaceable spring steel shaving head and retainer combination that protrudes from the top edge of the body and can be either single sided or double sided.

14 Claims, 5 Drawing Sheets

(56) References Cited

U.S. PATENT DOCUMENTS

| | | | | |
|---|---|---|---|---|
| 5,692,529 | A * | 12/1997 | Fekete | A45D 42/08 132/291 |
| 5,903,978 | A * | 5/1999 | Prochaska | A45D 27/29 30/34.05 |
| 5,927,298 | A * | 7/1999 | Tiram | A45D 42/08 132/289 |
| 6,182,366 | B1 | 2/2001 | Richard | |
| 6,499,218 | B2 | 12/2002 | Rocha | |
| 6,612,040 | B2 * | 9/2003 | Gilder | B26B 21/225 30/50 |
| 6,655,028 | B2 | 12/2003 | Coffin | |
| 6,868,610 | B2 | 3/2005 | Brandt et al. | |
| 6,946,624 | B1 | 9/2005 | Tomassetti | |
| 8,080,028 | B2 * | 12/2011 | Cagle | A61B 17/3211 30/142 |
| 8,307,552 | B1 | 11/2012 | Drouillard | |
| 8,479,624 | B2 | 7/2013 | Flyash et al. | |
| 8,510,957 | B2 | 8/2013 | Wain et al. | |
| 8,528,213 | B2 | 9/2013 | Szczepanowski et al. | |
| 2003/0046816 | A1 | 3/2003 | Kanzer | |
| 2006/0117568 | A1 | 6/2006 | Tomassetti | |
| 2008/0034589 | A1 * | 2/2008 | Nearing | B26B 21/222 30/32 |
| 2009/0217537 | A1 * | 9/2009 | Macdonald | A63B 29/08 30/350 |
| 2016/0151925 | A1 * | 6/2016 | Gers-Barlag | B26B 21/225 30/527 |

OTHER PUBLICATIONS www.livestrong.com "Hot Stone Therapy for the Face," by Brian Lewis Aug. 14, 2015.

* cited by examiner

FIG. 6
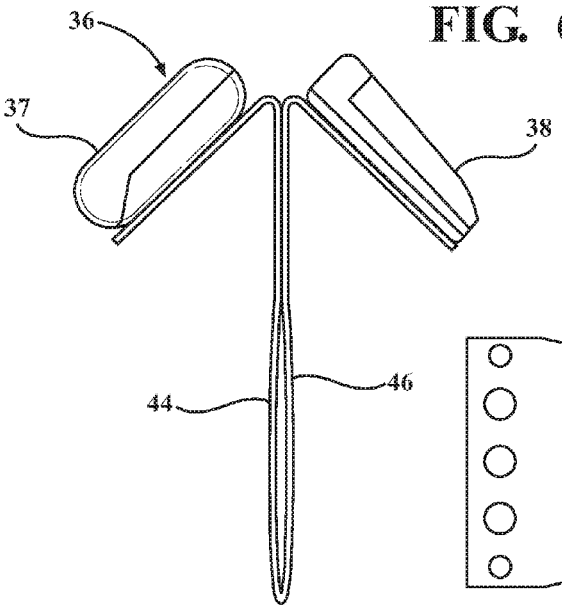
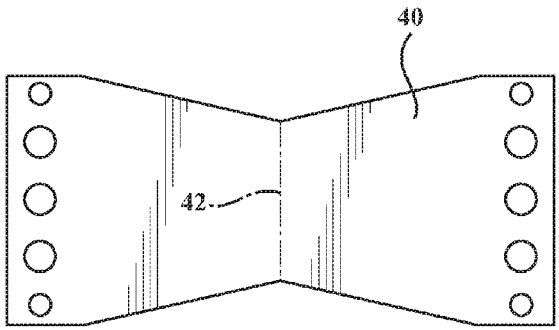
FIG. 7
FIG. 8
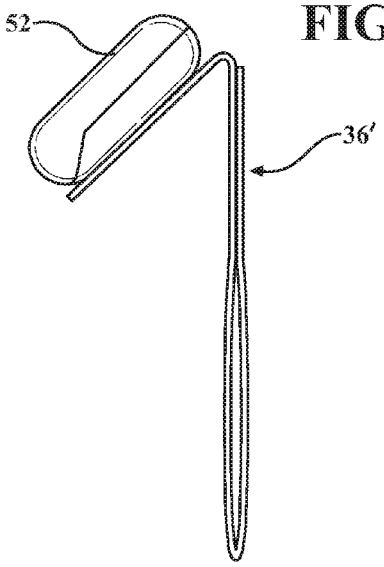
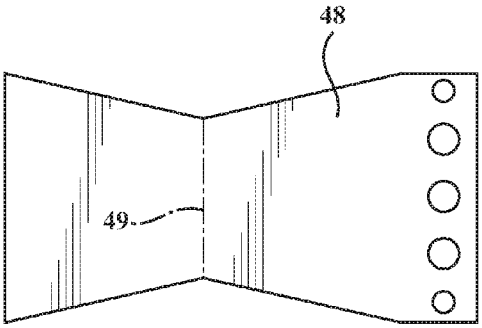
FIG. 9

HEAT-APPLYING SHAVING DEVICE

FIELD OF THE INVENTION

My invention is in the field of shaving devices and more specifically shaving devices adapted to be held in the hand and to absorb heat for application to the face or other body surface being shaved.

BACKGROUND

It has been well known for decades that comfort and efficiency in shaving with a blade type razor can be enhanced through the application of heat prior to and/or during the actual shaving process. The best known technique for achieving this is the application of hot moist towels to the human face prior to the beginning the actual shaving operation. This is typically carried out by professional barbers in barber shops and similar venues.

The stress relief and therapeutic benefit of massage that stimulates the muscles and lymphatic system is well known throughout the world. My device allows the user to experience a facial massage while being in complete control of the temperature and pressure applied to the skin. Conventional razors do not have the surface area of heat transfer properties that my device provides.

If used as directed, this device will save water and energy by retaining the heat that is wasted by conventional shaving methods. Unlike the thousands of plastic disposable razors that end up in landfills every day, our razor blades are mainly stainless steel and are designed to be recycled.

SUMMARY OF THE INVENTION

My invention is a heat applying shaving device which is adapted to be held in the human hand. The device includes a body comprising mating front and rear panels, one of which is made of a low heat absorbing material while the other panel is made of a high heat absorbing material. The low heat absorbing panel is the primary component held in the hand after heating in hot water so the high heat absorbing panel can be held against the face prior to and/or during the shaving operation. The low heat absorbing panel is preferably thicker than the mating panel, at least as far as outside dimensions are concerned, thereby substantially and comfortably fitting the hand. The low heat absorbing panel can be made of any of numerous low thermal conductivity materials including plastic and synthetic stone, but my preferred material is a natural stone such as granite that takes a high polish and it adds both weight and durability to the device. The heat-applying panel is preferably a metal such as titanium.

A shaving head which can either be single sided or double sided protrudes from a slot in the top of the body and is preferably mounted in such a way as to permit it to pivot back and forth through an angle of about 20 to 45 degrees.

To enhance the heat retention and transfer capability of the preferred embodiment of my invention, I hollow out the interiors of the two panels to create a chamber for a grooved metal insert. The grooves of the insert preferably match up with grooves in the metal panel and extend to and through the bottom surface of the body so as to permit hot water to enter into the interior of the body and remain within the interior for a period of time. In the preferred form the grooves have two different depths, the greater depth being up near the top of the body. This structure enhances the retention of water within the body while at the same time allowing it to drain efficiently through the bottom opening immediately prior to commencing the shaving operation.

While I describe the shape of the body as a rectangular prism or polyhedron it will be clear from the following description as well as from the accompanying drawings that the shape is that of a modified rectangular prism in that the corners are preferably beveled and the edges preferably rounded for comfort and improved appearance. While I show the exterior surfaces of both of the body panels being planar and parallel it will be apparent to the reader that the outer surfaces of both the stone and metal bodies can be curved to some degree according to the preferences of the designer.

The pivotal freedom of movement of the shaving head is achieved achieve by rotatably mounting a retainer in the form of a simple rollpin in a rounded groove between the two panels. A trapped pin limits the degree of rotation of the rollpin as well as prevents it from falling out of the body. The roll pin is open to one side edge of the body so that the shaving head may be simply and easily removed by sliding motion and replaced with another fresh shaving head for ongoing use.

BRIEF DESCRIPTION OF DRAWINGS

FIG. 6 is a side view of a doubled sided shaving head;

FIG. 7 is a plan view of a metal stamping which is folded to form the body 34 of the shaving head retainer;

FIG. 8 is a side view of a single sided shaving head; and

FIG. 9 is a plan view of an unfolded metal stamping which is used to form the part 48 of the single sided shaving head shown in FIG. 8. These drawings are to scale.

DETAILED DESCRIPTION OF THE ILLUSTRATIVE EMBODIMENT

Figure 1:
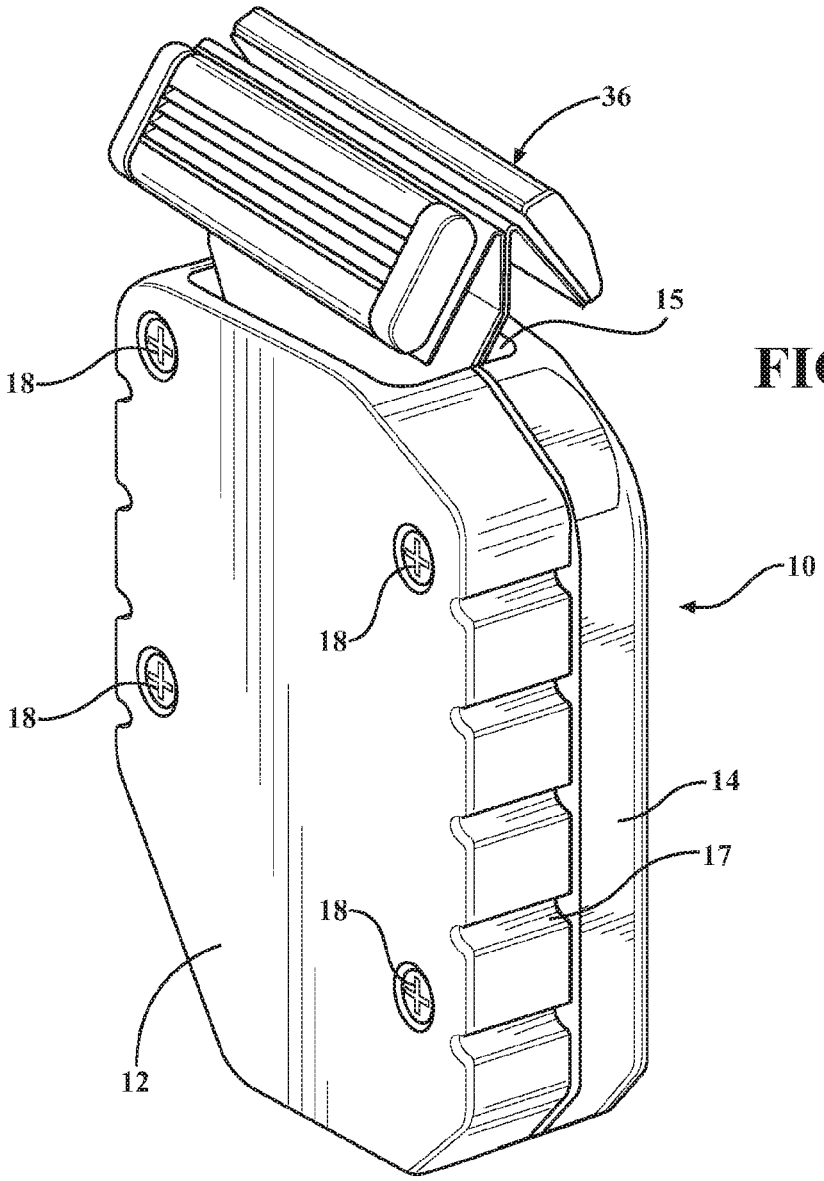
FIG. 1 is a perspective view of an illustrative embodiment of my invention using a double sided shaving head.

Referring now to FIGS. 1-4, I will describe in detail an illustrative embodiment of my invention in the form of a heat-applying shaving device 10 comprising a body having a shape approximately that of a rectangular prism and of a size which is adapted to be held comfortably in the adult human hand. As shown in the figures the body is made up of a first stone panel 12 and second metal panel 14 both of which have approximately the same peripheral shape and are held together by means of screws 18 although other means and manners of assembly are possible. The size of the body is approximately 6 cm in width by 8 cm in height by approximately 2 cm in thickness; these dimensions do not include the double side shaving head 36 which extends upwardly and outwardly from the top surface of the body through a beveled slot 15 formed by and between the two body panels.

I have found it advantageous to use a natural stone like granite for the panel 12 and titanium for the panel 14. The granite panel 12 is thicker than the metal panel 14 and has fluted sides 17 to enhance gripping. Panel 12 has a relatively low heat transfer index, a characteristic which is usually associated with materials of low thermal conductivity. My research indicates that granite has a specific heat of approximately 790 J/Kg K. Titanium has a specific heat of approximately 520 J/Kg K. As a result, when the device 10 is immersed in hot water panel 12 is heated less than panel 14; i.e. heat is taken up and stored where it does the most good in the application of heat to the area to be shaved. Titanium, therefore, heats up faster than granite and transfers its heat more slowly but has more heat to transfer.

Figure 2:
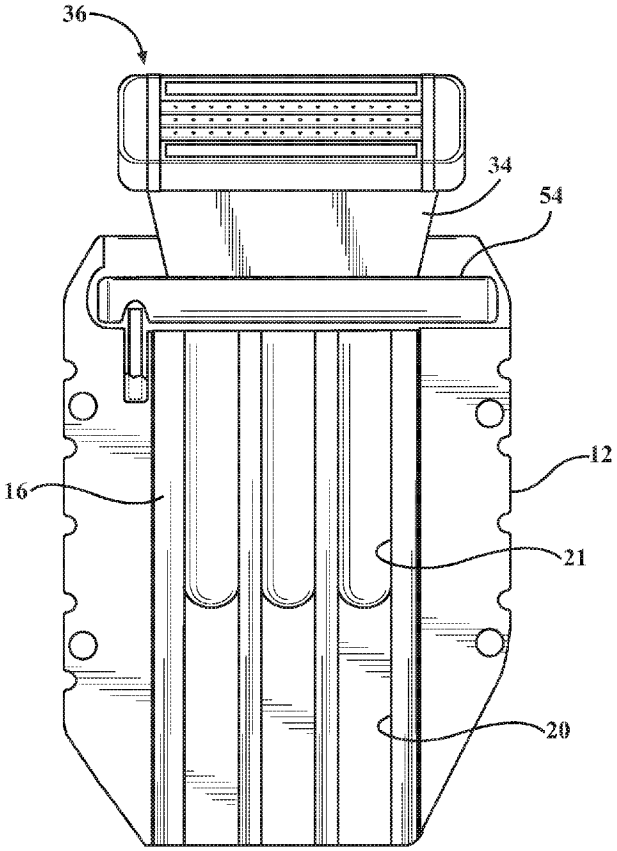
FIG. 2 is a plan view of the interior of the shaving device showing an insert and a pivotally shaving head retainer mounted within the stone panel.
Figure 4:
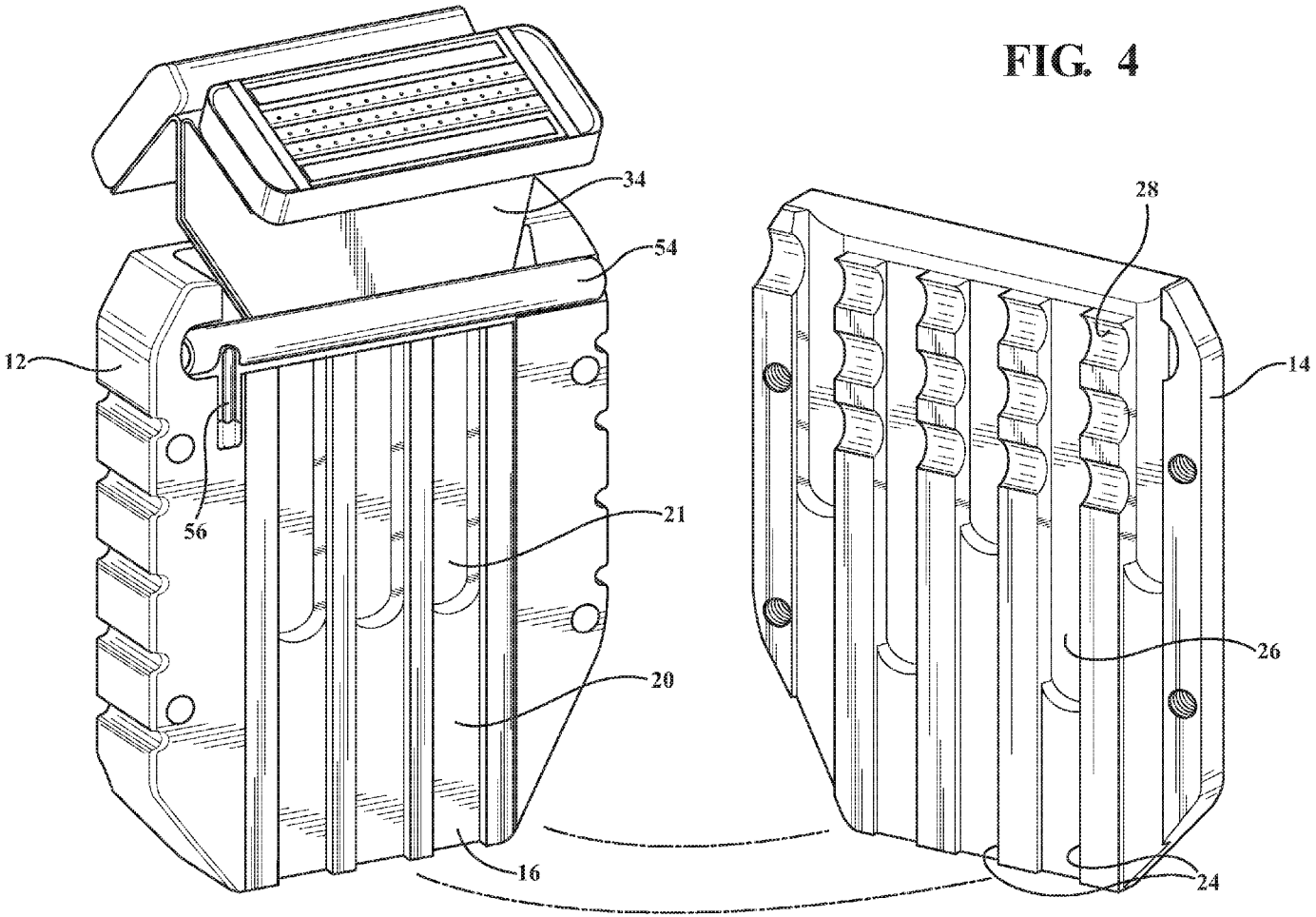
FIG. 4 is an exploded view of the entire shaving device with the stone and metal panels being separated from one another and rotated to illustrate the nature of the interior grooving which is used to enhance the retention.

As shown in FIGS. 2 and 4, the granite panel 12 is partially hollowed out on the interior surface thereof to receive a rectangular titanium insert 16 into which I have machined three vertical grooves 20, the upper portions 21 of which are deeper than the lower portions. Machined vertical grooves 24 are milled or machined into the interior face of the titanium panel 14 as shown in FIG. 4. Again, the upper portions 26 of grooves 24 are deeper to increase surface area and volume for hot water to enter the grooves during immersions. The grooves 20 and 24 open at the bottom edge of the device 10 to allow hot water to enter and drain.

A slotted roll pin 54 is located at the top of the insert 16 to receive and hold a shaving head 36 to be described. Pin 54 is allowed to rotate through an angle of between about 20 and 45 degrees, these limits of rotation as well as the retention of the roll pin 54 within the body of the device being achieved by means of a trapped pin 56 that extends up into a drilled/slotted hole near the left end of the roll pin 54 as shown in FIGS. 2 and 4. The roll pin 54, as I have already stated, is slotted to receive the metal body 34 of the shaving head 36 the details of which I will further describe with reference to FIGS. 6-9.

Figure 3:
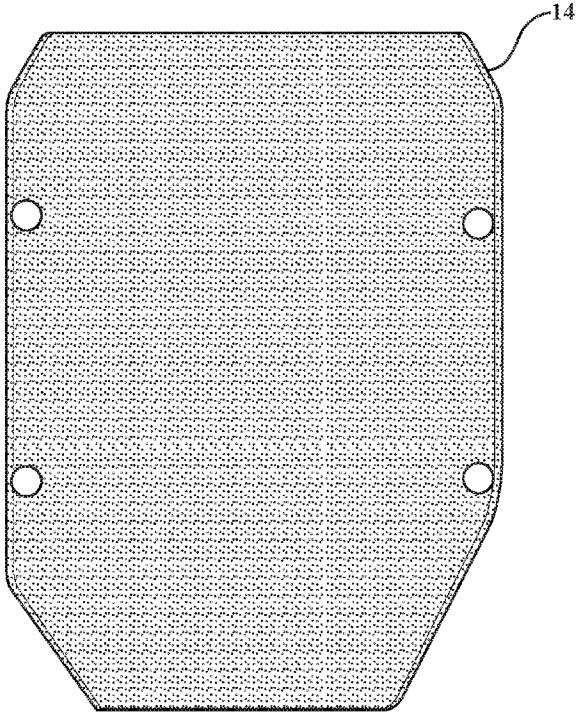
FIG. 3 is a plan view of the outside surface; i.e. the primary surface of the metal body panel.

FIG. 3 shows the exterior surface of the titanium panel 14 to be textured to provide comfort and improved heat transfer when placed against the face or other body part. As shown in FIG. 4, additional horizontal grooves 28 can be machined into the interior or panel 14; the top set hold the roll pin 54.

In the illustrative embodiment the volume of the titanium body panel is approximately 24 $cm^3$ while the volume of the grooved insert is approximate 9 $cm^3$ so the total volume of metal in the device is in the neighborhood of 33 to 35 $cm^3$. This means that the device will hold a substantial amount of heat which can be transferred by the user by holding the primary; i.e. exterior surface of the titanium panel 14 against the face prior to and/or during the shaving operation. The primary surface or face of the panel 14 is preferably flat but can be somewhat curved. The total exterior volume of the body is between about 50 to 100 cubic centimeters.

Turning now to FIGS. 6-9, I draw the reader's attention to FIGS. 6 and 7 which illustrate a manner and mode of making a slide-in, replaceable, double sided shaving head 36. The structure 34 starts with a flat stamped stainless steel plate 40 having holes formed by punching in rows near the left and right edges and center fold line 42. The plate 40 is then folded to the configuration shown in FIG. 6 with the top ends of the folded sides 44 and 46 being bent back in mirror image style to provide flat surfaces onto which conventional blade type shaving heads 37 and 38 can be adhesively bonded. These shaving heads can be similar to or identical to any of various commercially available heads made by manufactures such as Gillette® and Schick® as well as other manufacturers. The preferred shaving heads are made of plastic with multiple stainless steel blades and in most cases a polymeric panel running parallel to the blades to reduce friction as the shaving head passes over the face.

As shown in FIGS. 8 and 9 a single sided shaving head 36' can be manufactured in a similar fashion using a stamped stainless steel plate 48 with a center fold line 49. After being folded into a two-ply shaped as shown in FIG. 8 the longer side is bent back on itself to form an angle about 40 degrees and to provide a flat outside surface to which a conventional shaving head 52 is adhesively bonded.

Figure 5:
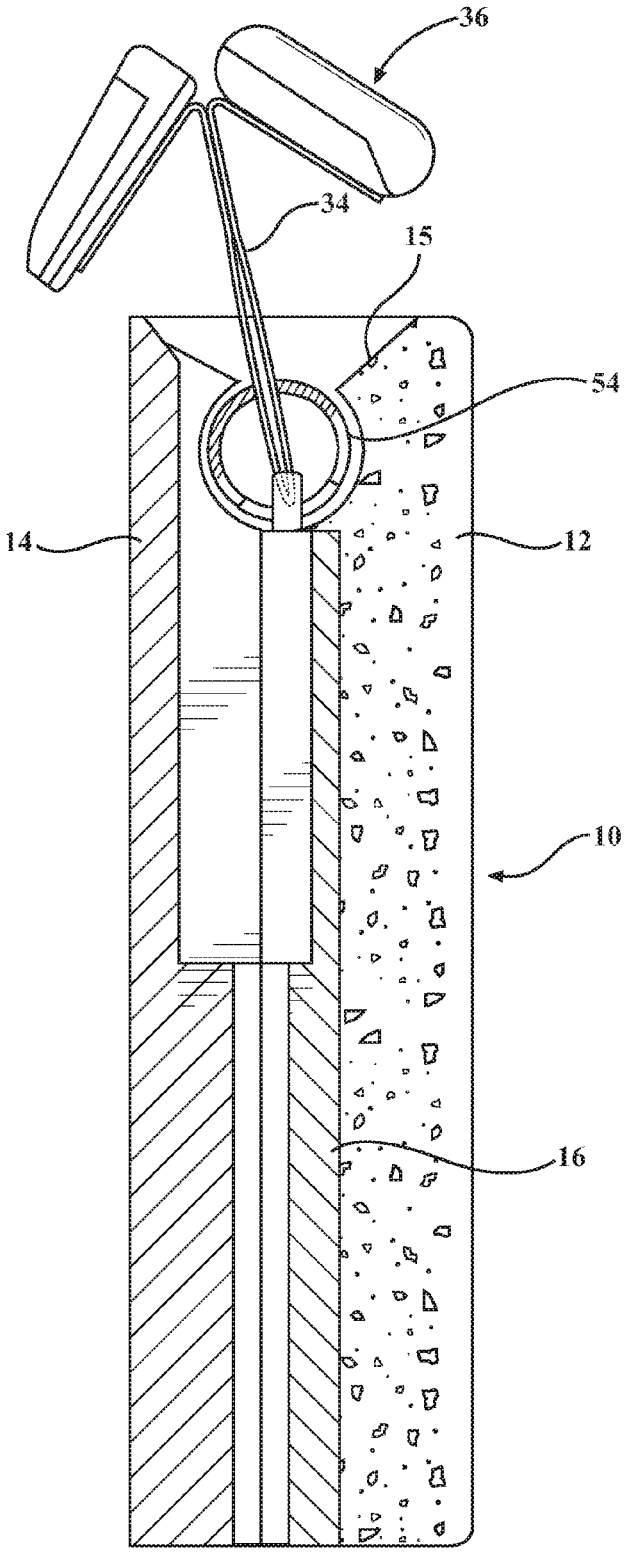
FIG. 5 is a side view partly in section of the assembled shaving device illustrating water entrance and egress grooves and the pivoting double side shaving head.

The folding of the metal plates 40 and 48 is done in such a way or to provide the two ply body some space between the parallel legs as shown. This provides spring action when one or the other of the two shaving heads is slideably inserted into the slotted roll pin 54 of the shaving device through the opening in the right side of the structure as shown in FIG. 2; i.e. spring metal retainer slides into the roll pin slot to assume the position as shown in FIGS. 4 and 5. This permits a new shaving head to replace a used shaving head at a time interval determined by the user.

In summary, I provided a two-panel heat retaining shaving device with a replaceable pivotal blade type shaving head and a body with shape approximating a rectangular prism or polyhedron and configured to be held in the human hand. In operation the entire device is immersed in a pool of hot water such as one may achieve in a conventional bathroom wash basin. The volume of the high heat retaining material in panel 14 and insert 16 is such that the device will heat up in matter of minutes after which the cooler surface of the stone panel 12 is held in the hand, against the palm of the hand, while the primary exterior surface of the metal/titanium panel 14 is held against the face. Heat is transferred to the face to soften the whiskers and add comfort to the shaving operation which immediately thereafter carried out preferably with the use of friction reducing material such as a shaving foam or gel.

Although I have described my device with respect to a specific and preferred embodiment it will be understood that various modification to the device which I have shown can be made; e.g. the specific shape of the body can be altered to a degree as long as it retains the necessary physical characteristic that allow it be hand held and providing a primary surface which can be placed against the face for heating purposes. It is highly preferable to enhance the heat retention of the device by having an interior insert albeit the insert may be made as an integral part of the titanium panel with holes drilled in through the bottom rather than provided by grooves in the mating components. In addition, the panel 12 may be made of plastic, filled plastic or any of the synthetic or man-made stones like Corian®.

What is claimed is:

1. A heat-applying shaving device comprising:

a body having a shape approximating a rectangular prism with a top, a bottom and first and second opposite exterior surfaces;

said body comprising a first panel of relatively high heat absorbing material defining said first exterior surface and a second panel joined to the first panel and of a relatively low heat absorbing material and defining said second exterior surface;

a shaving head mounted to said body to extend outwardly from said top;

whereby the body, after being heated is configured to be held with the first exterior surface against a surface to be shaved for heating while the body is being held with the second exterior surface in a user's hand; and said device further comprising a metal insert disposed within the body and held in place between and in contact with said first and second panels.

2. The heat-applying shaving device defined in claim 1 wherein said shaving head is pivotally mounted to said body for pivotal movement through an angle between 20 and 45 degrees.

3. A heat-applying shaving device as defined in claim 2 further comprising:

a retainer pin mounted within the body for limited rotation about its longitudinal axis, said shaving head being mounted to said retainer pin and protruding from a beveled slot in the top of said body and formed in part by each of said first and second panels.

4. A heat-applying shaving device defined in claim 1 wherein the first panel is metal.

5. A heat-applying shaving device as defined in claim 4 wherein the metal is titanium.

6. A heat-applying shaving device as defined in claim 1 wherein the material of the second panel is one of an artificial or natural stone.

7. A heat-applying shaving device as defined in claim 6 wherein the stone is granite.

8. A heat-applying shaving device as defined in claim 1 wherein the insert is configured with parallel grooves extending substantially between said top and bottom and parallel to the first and second exterior surfaces.

9. A head-applying shaving device as defined in claim 8 wherein said grooves are open to the bottom so that water can be ingested into the interior of said body for heating purposes, and drained therefrom.

10. A heat-applying shaving device as defined in claim 1 wherein the second panel is thicker than the first panel.

11. A heat-applying shaving device as defined in claim 1 wherein said shaving head comprises:

a flat stamped metal body with two reversely angled mirror image blade head holders at one end; and shaving blades mounted to the outside surfaces of each of said blade head holders.

12. A shaving head assembly adapted for installation in a hand held shaver body wherein said head assembly comprises:

a stamped flat metal body having opposed free ends and folded onto itself along a fold line to form opposing folded sides, each folded side having been folded at a predetermined distance from a respective one of the opposing free ends to form a pair of reversely angled plane surfaces, each of said surfaces having adhesively bonded thereto a shaving head.

13. A heat-applying, hand-held shaving device comprising:

a body having a top end and a bottom end and including first and second mating panels of differing heat transfer indices, the first outside panel being configured for grasping in a user's hand while the second outside panel is placed against a face to be shaved;

said body having an interior core intermediate said panels and having a heat-transfer index essentially matching that of the second panel;

a plurality of channels formed in said core and opening to the bottom end of said body to ingest and drain hot water into said core to heat the second panel; and a blade shaving head mounted to the top end of the body.

14. A heat-applying, hand-held shaving device as defined in claim 13 wherein the core is metal and the shaving head is pivotally mounted.

* * * * *